US005352154A

United States Patent [19]

Rotter et al.

[11] Patent Number: 5,352,154

[45] Date of Patent: Oct. 4, 1994

[54] METAL ROOF VENTILATION SYSTEM

[75] Inventors: Martin J. Rotter, Glenside, Pa.; William W. Collins, Wayne, N.J.

[73] Assignees: Martin Rotter; Building Materials Corporation of America, Wayne, N.J.; a part interest

[21] Appl. No.: 145,930

[22] Filed: Nov. 1, 1993

[51] Int. Cl.[5] ..... F24F 7/02

[52] U.S. Cl. ..... 454/365; 52/57

[58] Field of Search ..... 52/49, 57, 357, 358, 52/359, 360, 489.1, 528, 90.1; 454/365

[56] References Cited

U.S. PATENT DOCUMENTS

| | | | |
|---|---|---|---|
| 2,160,642 | 5/1939 | Bumpas et al. . | |
| 4,545,292 | 10/1985 | Inokawa et al. | 454/365 |
| 4,685,265 | 8/1987 | Couper | 454/365 X |
| 4,876,950 | 10/1989 | Rudeen | 454/365 |
| 4,942,699 | 7/1990 | Spinelli | 52/57 |
| 5,167,579 | 12/1991 | Rotter | 454/365 |

FOREIGN PATENT DOCUMENTS

| | | | |
|---|---|---|---|
| 1949035 | 4/1971 | Fed. Rep. of Germany | 52/57 |
| 2399515 | 3/1979 | France | 454/365 |

*Primary Examiner*—Harold Joyce

*Attorney, Agent, or Firm*—Seidel, Gonda, Lavorgna & Monaco

[57] ABSTRACT

A roof ventilation system for ventilating a building with a metal roof formed of a series of metal panels joined by standing seams, and having a vent slot disposed along the roof ridge in proximity to an edge of the metal panels. A plurality of clips are disposed at intervals on each side of the vent slot. Each clip is adapted to slip onto the upper edge of the metal panels and to straddle one of the standing seams. The clip includes a top cap-engaging portion, a hook portion formed by a lower leg and an upper leg spaced for receiving the upper edge of adjacent metal panels, and a wall portion which extends between the upper leg of the hook portion and the cap-engaging portion. The cap-engaging portion, the upper leg and the wall portion define a channel adapted to retain sections of air-permeable venting material along the vent slot. A slot in the clip extends through the upper leg and the side wall for receiving the standing seam. The clip may be formed from a flat rectangular sheet.

A plurality of air-permeable venting material sections extend between adjacent clips on one side of the open slot and substantially fill the channels in the clips. A cap element overlies the venting material sections and spans the open slot.

10 Claims, 5 Drawing Sheets

METAL ROOF VENTILATION SYSTEM

FIELD OF THE INVENTION

This invention is related to the general field of attic and roof ventilation systems. It is particularly related to a clip that slides on to a metal roof to receive a venting material and space a ridge cap from the ridge of the metal roof.

BACKGROUND OF THE INVENTION

It has been a long known practice to ventilate attics under gable roofs by running a vent along the roof ridge. Such vents are created by an open slot running along the roof ridge, essentially the length of the roof, which causes ventilation out of the attic by convection airflow and by suction from wind blowing across the roof.

A soffit ventilation system is frequently used in conjunction with a ridge vent to provide passive ventilation. The soffit vents allow fresh ambient air to flow into the attic to equalize attic temperature and pressure with the outside. As stale hot air is withdrawn from the ridge slot vent by convection and/or wind suction, it is replaced by fresh ambient air entering the attic through the soffit vents.

The effectiveness of the ridge vent depends upon the degree to which convection outflow and wind across the vent line is uninhibited by the vent structure. Most effective would be a completely uncovered slot, but the need to keep out rain water, dirt and pests requires some sort of covering or capping structure. Design consideration for a vent structure includes, therefore, an attempt to maximize convection and suction outflow while establishing an effective barrier against water, dirt and insect entry, creating or maintaining an aesthetic appearance of the roof, long term durability, low cost construction, and ease of installation.

Differences between the various types of ridge vents are often found in the capping structures used over the vent slot. A description of representative types of ridge vents and capping structures, and attributes or problems associated with various types, is found in a prior patent of this co-inventor, U.S. Pat. No. 5,167,579 (Rotter). That patent discloses, as a solution to many of the problems associated with prior ridge vents, an improved roof ridge venting system using a unitary mat constructed of randomly-aligned synthetic fibers which are joined by phenolic or latex binding agents and heat cured to provide an air-permeable mat with a varying mesh. Cap shingles are supported by the mat and are nailed directly to the roof through the mat. In contrast to other vent materials, the unique features of the mat disclosed in the Rotter patent result in many desirable physical properties such as high tensile strength, high resiliency, the ability to be transported in rolls and cut to length, ease of joining strips, durability in local ambient conditions, and an excellent water and insect barrier. Moreover, it provides the aforementioned desirable features in a thin sheet to permit the vent structure to maintain a low profile along the roof.

Although the vent disclosed in the Rotter patent has desirable applications in many roof types, some of its advantages begin to diminish when it is used in conjunction with metal roofs. Metal roofs panels have a high thermal conductivity and therefore expand and contract with temperature changes during the day and through the seasons. Nails extending from the cap through the metal panels into the roof sheathing have a tendency to loosen and pull out with this repetitive expansion and contraction. It is therefore more common to have ventilation cans on the metal roof, or wall vents located on gable ends of the building rather than ridge vents on metal roofs.

A ridge vent structure useable with a metal roof should not only exhibit desirable passive ventilation features, it should allow expansion and contraction of the metal roof panels while supporting and/or anchoring the cap elements and ventilating material, and retain them in proper position even in high wind and other adverse environmental conditions, such as temperature extremes and the accumulation of heavy layers of snow or ice. This invention is directed to meeting such objectives.

Other objects, aspects and advantages of the present invention will be apparent to those skilled in the art upon reading the specification, drawings, and claims which follow.

SUMMARY OF THE INVENTION

The invention is generally directed to a roof ventilation system for ventilating a building having a sloped metal roof formed of a series of metal panels joined by standing seams. A vent slot is disposed along the roof ridge to permit air from interior space under the roof to flow through the slot to the exterior, and a ridge cap is supported and secured over the slot. The invention is characterized by a plurality of clips disposed at intervals on each side of the vent slot, each clip engaging with an upper edge of the metal panels and straddling a standing seam. The clips are adapted to support and secure the ridge cap and to retain air-permeable venting material along the vent slot.

Each clip includes a cap-engaging portion for supporting and securing the ridge cap, a hook portion having a lower leg and an upper leg spaced from each other for receiving an upper edge of adjacent metal roof panels, and a wall portion extending between the upper leg of the hook portion and the cap-engaging portion, wherein the cap-engaging portion, the upper leg and the side wall portion define a channel for retaining air-permeable venting material. A slot through the wall portion and at least partially through the cap-engaging portion and upper leg is adapted for receiving the standing seam. A plurality of sections of air-permeable venting material is retained in the channels and extend along the vent slot, said material permits ventilating air flow while providing a barrier to water, dirt and insects.

This invention also includes the method of forming the clips and installing the novel ventilator system described above.

BRIEF DESCRIPTION OF THE DRAWINGS

For the purpose of illustrating the invention, the drawings are of forms which are presently preferred. However, the invention is not limited to the precise arrangements and instrumentalities shown.

DETAILED DESCRIPTION OF THE INVENTION

Figure 1:
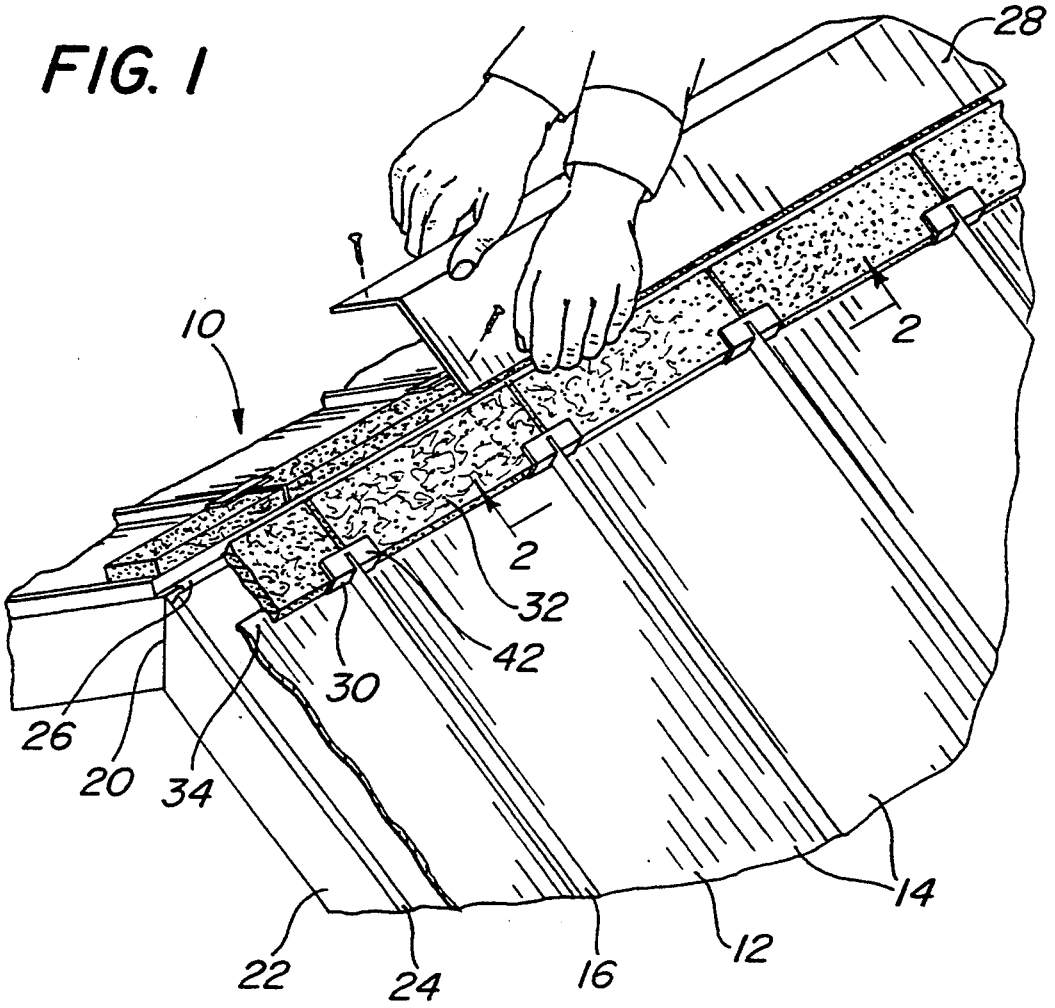
FIG. 1 is a perspective view of a portion of a roof ridge showing an embodiment of the roof ridge ventilator of the present invention installed thereon.

In the drawings, like numerals are used to indicate like elements and primes (′ and ″) are used to indicate counterparts of such like elements. FIG. 1 illustrates one embodiment of a roof venting system designated generally as 10, in accordance with the present invention. The roof venting system is described in relation to a sloped roof 12 which is covered by several metal panels 14, with adjacent panels being joined together using a standing seam 16. The roof comes to a ridge 20 at a slope defined by its rafters 22. The metal panels 14 extend up to the ridge 20 where they are covered with a ridge cap 28, usually made of similar metal as the panels and installed in sections running along the ridge.

In typical metal roof construction, the ventilation from under the roof is done using can-type ventilators or gable end vents. An open ridge vent slot is not typically found in connection with a metal roof. Consequently, in a metal roof which does not use ridge venting, the upper row of plywood sheathing panels which underlies the metal panels extends right up to the ridge crest.

Thus, the venting system 10 of this invention is similar to ridge vents more commonly found in asphalt shingle construction, in that the upper row of sheathing 24 terminates approximately ¾ to 1 inch short of the crest of the ridge, therein defining an open vent slot 26. The vent slot 26 may be created during construction of the roof, or retro-fitted using a circular saw to cut a slot in the sheathing.

This roof ventilation system includes a plurality of clips 30 securing air-permeable venting material sections 32 in position along the vent slot 26. The clips are slipped onto an upper edge 34 of the metal panels 14, straddling the standing seam 16. The air-permeable venting material sections 32 extend between adjacent clips 30 located on the same side of the open vent slot 26. The ridge cap 28 is secured to the clips 30 by a series of screw fasteners 36. Although other air-permeable mesh materials could be used, the preferred venting material 32 is a strip of non-woven synthetic fiber matting, as described in U.S. Pat. No. 5,167,579 (Rotter), which is incorporated by reference, and which further defines the properties of the preferred material.

Figure 2:
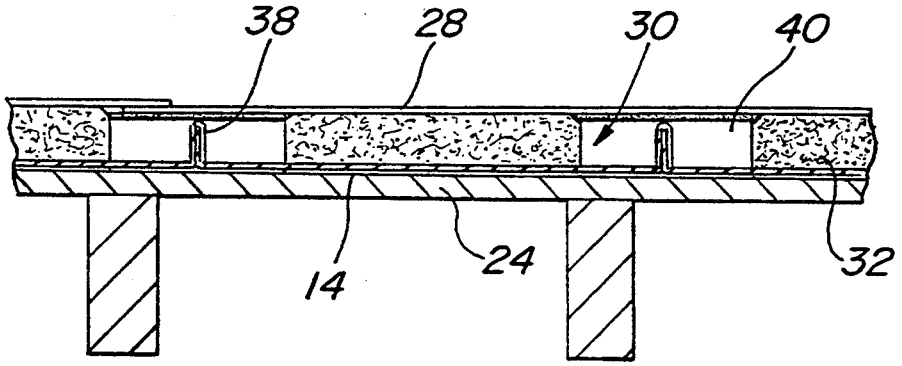
FIG. 2 is a cross-sectional view of the roof ridge ventilator illustrated in FIG. 1 and taken along line 2—2.

As known to those in the art and shown in the side cross-sectional view of FIG. 2, adjacent metal panels 14 are joined together by lateral ends 38 projecting vertically upward, with the top of one lateral end of one of the panels 14 crimped over the lateral end of the adjacent panel to form the standing seam 16. The metal panels 14 are secured by nails to the sheathing panels 24 at various position along the roof, but not at the upper edge of the metal roof (i.e. in proximity to the vent slot 26) in order to allow the metal roof 12 to expand and contract.

Figure 5:
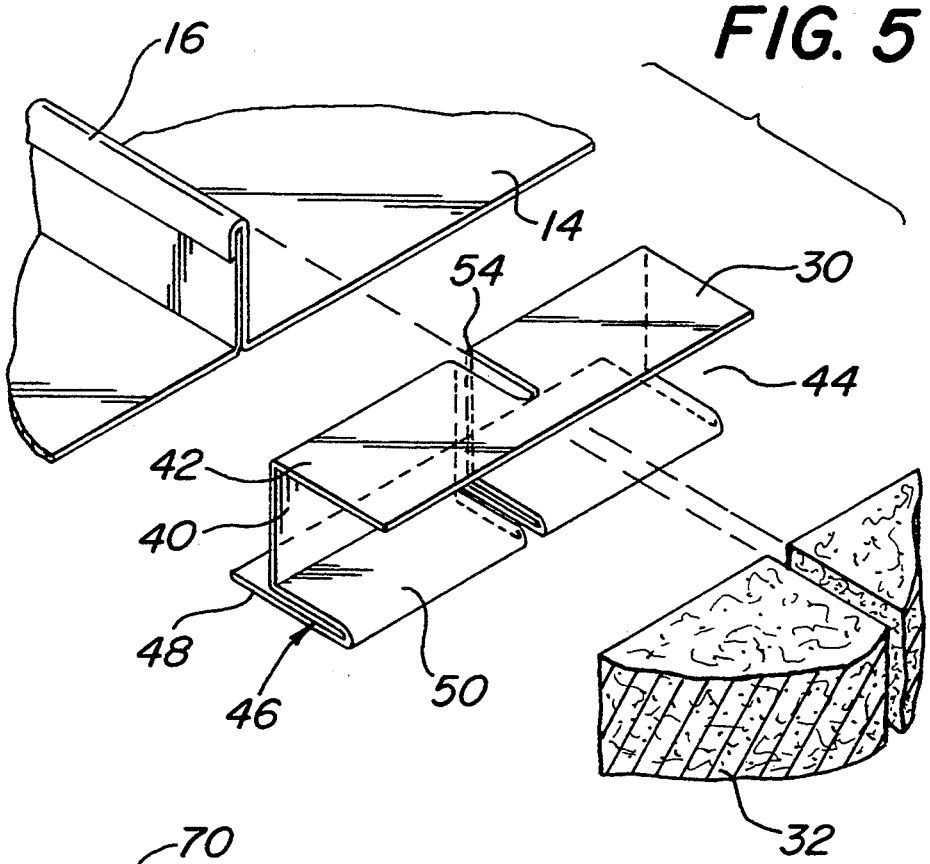
FIG. 5 is an exploded perspective view of a section of the metal roof, a clip and venting material of the embodiment depicted in FIGS. 1–3.

The clip 30 has a slot 54, as best seen in FIG. 5, which receives the standing seam 16 as the clip 30 is placed onto the metal panels 14, and prevents the clip from sliding along the upper edge of the panels. The clip 30 also has a side wall 40, which defines the height at which the ridge cap 28 is spaced above the flat portion of the metal panels 14, and an upper cap-engaging portion 42. The height of the side wall 40 is preferably selected such that the ridge cap-engaging portion 42 of the clip 30 is flush with the top ends of the standing seams 16.

The clip 30 further defines a channel 44 to receive the air-permeable venting material 32. The venting material 32, which is installed in the clips between standing seams 16 prior to installing the ridge cap 28, is slightly thicker than the channel 44 so that the venting material 32 must be compressed slightly to be inserted into the channel 44. The venting material 32 completely fills the vertical space between the metal panels 14 and the ridge cap 28 to provide a water, dirt and insect barrier, while permitting ventilation.

Figure 3:
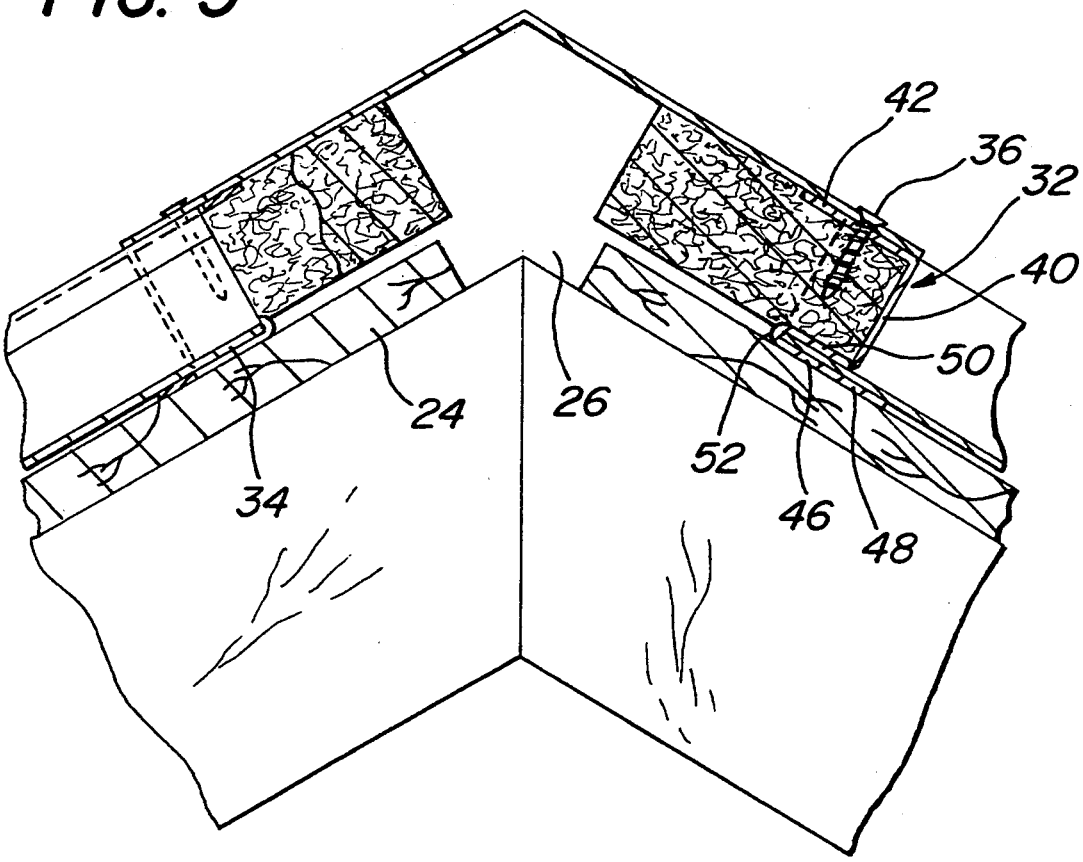
FIG. 3 is a cross-sectional view of a portion of the roof ridge of FIG. 1, showing an embodiment of the roof ridge ventilator of the present invention installed thereon.

Referring to FIG. 3, the sectional view shows the open vent slot 26 between the sheathing panels 24. The clips 30 each have a hook portion 46 defined by a lower leg 48 and an upper leg 50 spaced by a curved portion 52, which is slipped over the upper edge 34 of the metal panels 14. A corner of the venting material 32 may be compressed slightly by hand, and then slid into the channel 44 until engagement with the side wall 40 of the clip. The venting material 32 not contained within and compressed by the clip 30 preferably extends above the clip 30 into engagement with the ridge cap 28. A fastener 36 extends through the ridge cap 28, through the upper cap-engaging portion 42 of the clip 30, and into the air-permeable venting material 32.

Figure 4:
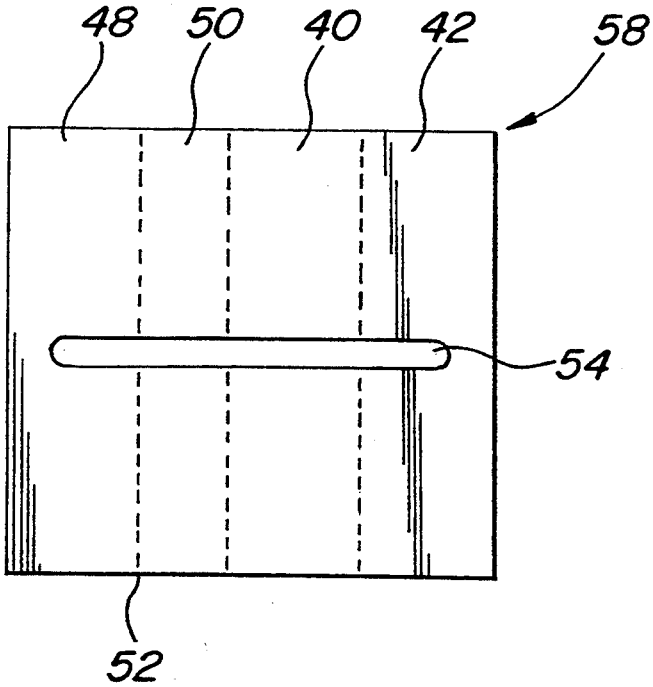
FIG. 4 is an overhead view of a flat sheet of a material with stamping thereon to form a clip as described in the specification.

The clip 30 is manufactured, and may be delivered to the job site, as a generally rectangular flat sheet 58 with a through slot 54 along its longitudinal centerline, as shown in FIG. 4. The preferable sheet material is 18 gauge aluminum. The sheet 58 is manufactured with the slot 54, and may be stamped or scored with grooves or perforations to facilitate it being bent into the clip 30. However, in the preferred embodiment, there are no stamps or scores and the sheet 58 is bent at the job site using a metal break to allow for accurate sizing of the side wall 40 to that of the vertical standing seam 16. The dash lines shown on the sheet 58 indicate representative fold grooves to form the clip 30, as described below.

The flat sheet 58 may first be folded approximately 90° at the right-most dash line of FIG. 4 to form the upper cap-engaging portion 42 and an interim long portion. Folding the long portion at the next from right dash line approximately 90° in the same direction as the cap engaging portion forms the wall portion 40 and an interim (still straight) hook portion. Folding the interim hook portion in the opposite direction at the left-most dash line to reflect back approximately 180° forms the upper leg 50 and lower leg 48 wherein the reflected bend defines the curved portion 52. It should be apparent that the folds could be done in reverse order.

FIG. 5 shows that when the sheet is bent to form a clip 30, the channel 44 is defined by the upper leg 50 of the hook portion 46 and the cap engaging portion 42. The hook portion 46 slides onto the metal panels 14 with the vertical standing seam 16 being received by the slot 54. A comer of a section of air-permeable venting material 32 is then slightly compressed and inserted into the channel 44. The thickness of the venting material is preferably chosen such that the venting material is at least flush with, and preferably slightly compressed by, the cap-engaging portion 42.

The roof venting system 10 is installed after the metal roof panels 14 are installed on a roof 12 having a ridge slot 26. The metal panels 14 are placed on and secured to the roof's sheathing panels 24 with lateral ends 38 abutting and crimped together, as is well known practice in installing such panels. The metal panels 14 terminate short of the crest of the ridge such that the upper edge 34 of the metal panels 14 is spaced from the ridge slot 26 approximately the width of a section of air-permeable venting material (i.e. six to eight inches). The metal panels 14 are secured to the sheathing panels 24, but not in proximity to the slot 26.

Referring to FIG. 4, the flat sheet 58 is bent to form the clip 30 with a hook portion 46 sized to the thickness of the metal panels, and with a side wall 40 of a proper size relative to the thickness of the venting material and to the standing seem 16, preferably such that the venting material is slightly compressed in the clip and the upper cap 42 is flush with the top of the standing seam 16 when installed.

Referring to FIG. 5, the hook portion 46 of the clip 30 is slipped over the upper edge 34 of the metal panels 14 straddling the standing seam 16, with the slot 54 receiving the standing seam 16. A corner of a section of the venting material 32 is compressed slightly to slide into the channel 44. The sections of venting material 32 are placed in this manner such that the sections extend along the vent slot between adjacent clips 30.

Referring to FIG. 1, the ridge cap 28 is installed in overlapping sections such that it extends across the open vent slot 26 and covers the adjacent venting material 32, and each section of the cap is secured by screws 36 to the clips 30. Referring to FIG. 2, the venting material 32 completely tills the space between the panels 14 and the ridge cap 28 to prevent water, dirt and insects from entering, but allows the passage of air.

As shown in FIG. 3, the screw 36 extends into the venting material 32 but does not secure the clip 30 or panels 14 to the sheathing panels 24, therein allowing the upper edges of the metal panels 14 to expand or contract relative to the plywood sheathing panels 24 due to their differing properties of thermal expansion. When the metal roof expands or contracts with thermal changes, the upper edge 34 of the metal panels 14 moves closer or further away from the open vent slot 26. When the clip 30 and the air-permeable venting material 32 move with the panels 14, the thin metal cap 28 will flex up or down to compensate for the change in distance between the upper edges of the metal roof on either side of the vent slot 26. Therefore, the ridge cap may move along with the thermal expansion of the panels without being loosened or dislodged.

Figure 6:
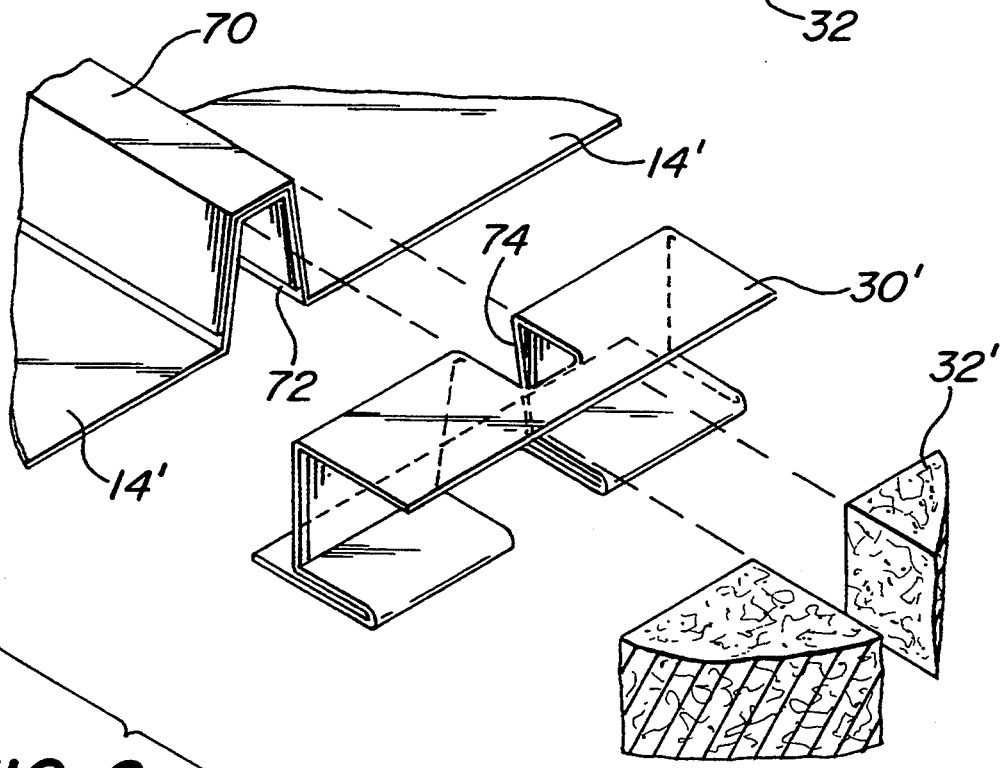
FIG. 6 is an exploded perspective view similar to FIG. 5, for an alternative metal roof having alternative embodiment of the metal clip.

FIG. 6 shows an alternative embodiment wherein the metal panels 14' are connected with a wider standing seam 70 consisting of each lateral end 38' having an inverted U-shape 72 wherein one inverted U-shape overlaps the other. The alternative clip 30' is formed with a tapered slot 74 which is large enough to facilitate receiving the inverted U-shape 72.

Figure 7:
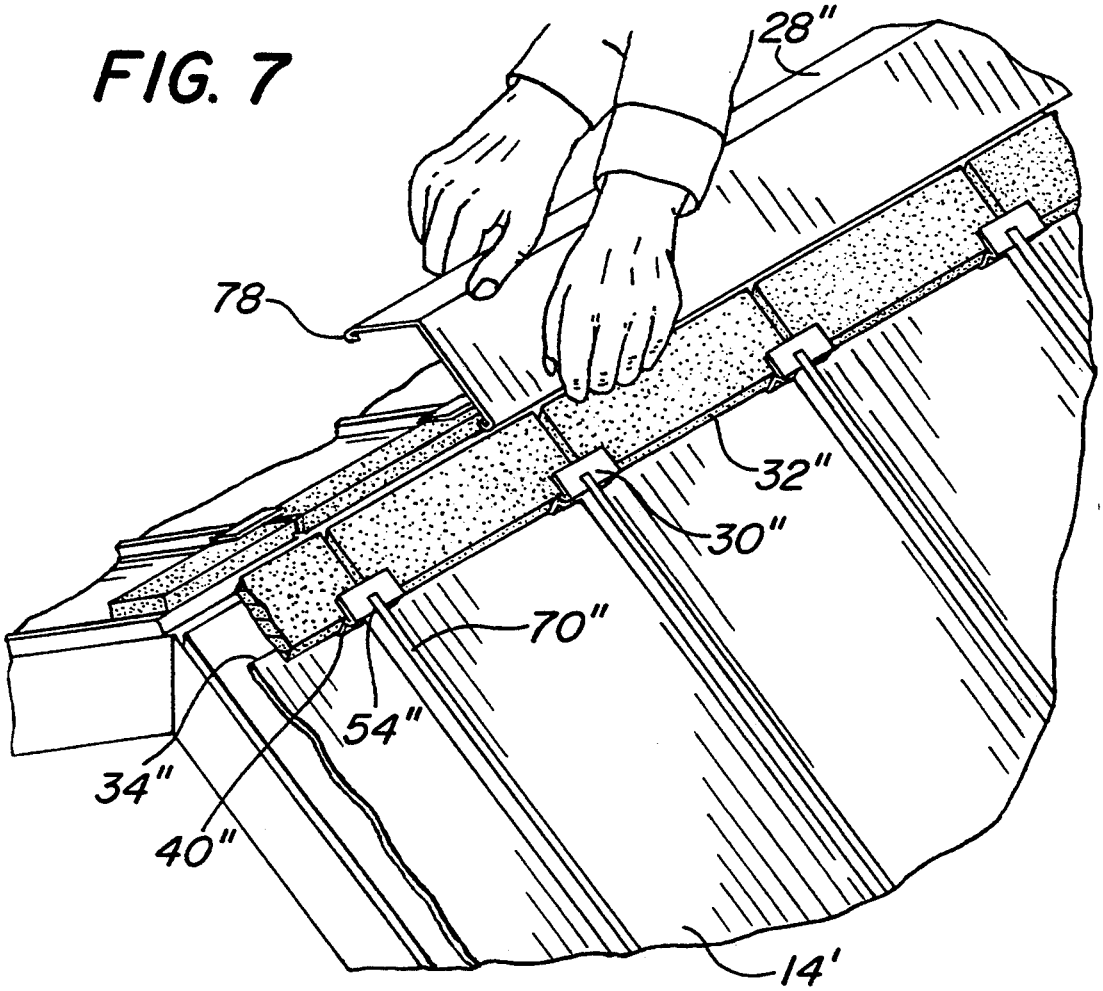
FIG. 7 is a perspective view of a portion of a roof ridge similar to FIG. 1, showing another embodiment of the roof ridge ventilator of the present invention installed thereon.
Figure 8:
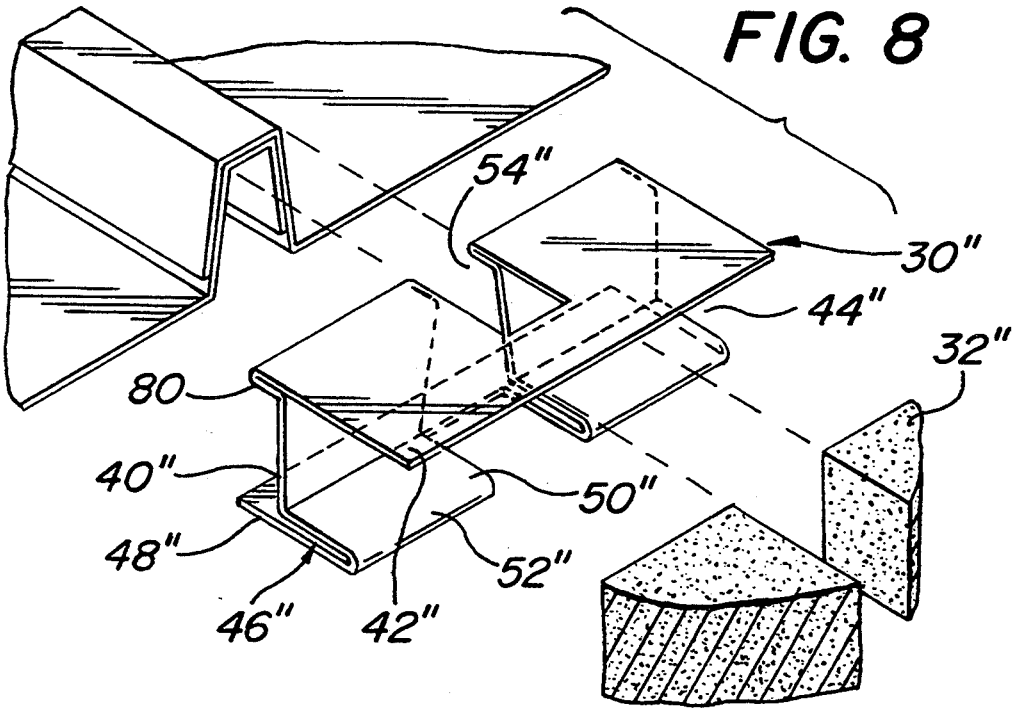
FIG. 8 is a view similar to FIG. 5, for the embodiment of the roof ridge ventilator and metal clip of FIG. 7.
Figure 9:
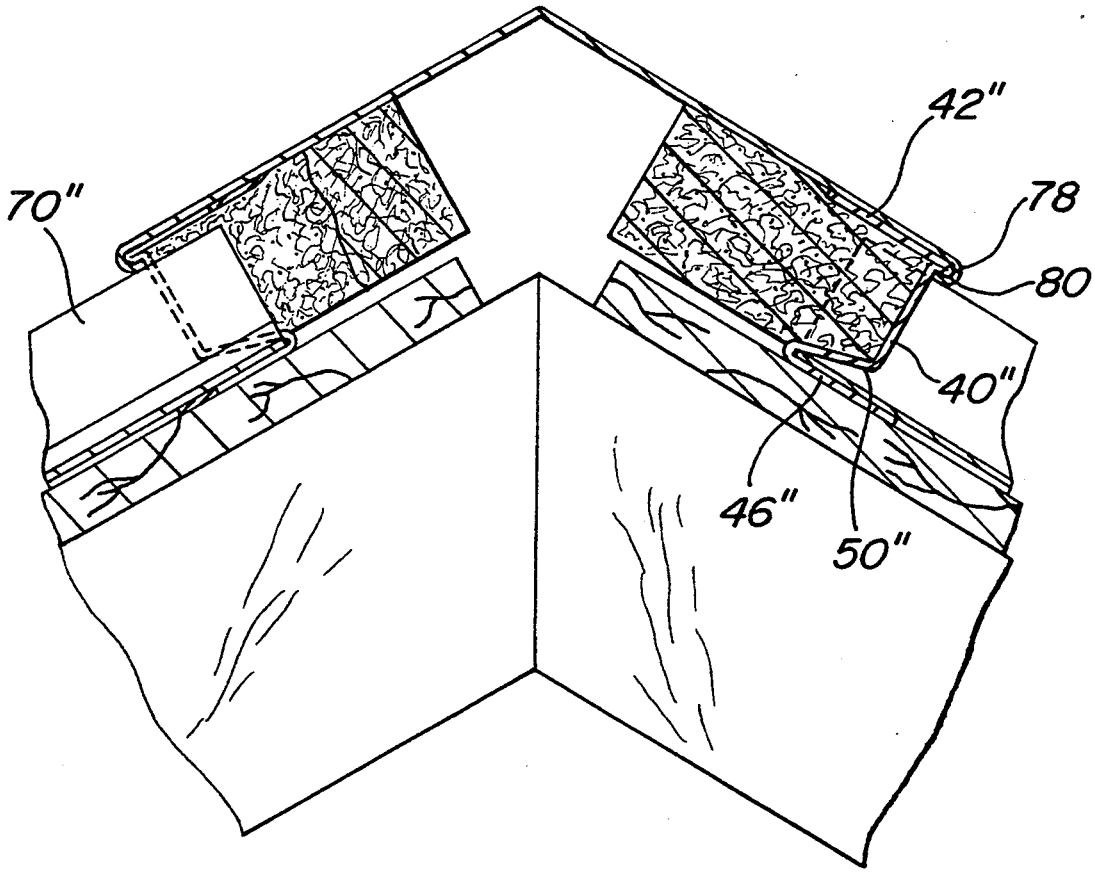
FIG. 9 is a cross-sectional view similar to FIG. 3 of a portion of the roof ridge of FIG. 7, showing that embodiment of the roof ridge ventilator installed thereon.

A third embodiment is shown in FIGS. 7–9. Referring to FIG. 7, the clip 30'' slips on the upper edge 34'' of the metal panels 14'' straddling the standing seam 70'', similar to the first two embodiments. The standing seam 70'' is shown as having the inverted U-shape 72'' similar to the second embodiment, as best seen in FIG. 8, but it will be apparent that the clip 30'' as described below could easily be formed for a roof 12 having a narrow standing seam as in the first embodiment. The metal ridge cap 28'' of this embodiment is slightly different in that it has a curved lip edge 78 for securing to the clips 30'', as described below.

The clip 30'' has a slot 54'' which receives the standing seam 70'' as the clip 30'' is placed onto the metal panels 14'', and prevents the clip from sliding along the upper edge 34'' of the panels. The slot 54'' is tapered to conform to the shape of the standing seam 70''. The clip 30'' has a side wall 40'' which defines the height at which the ridge cap 28'' is spaced above the flat portion of the metal panels 14''. Referring to FIG. 8, the clip 30'' has a lip portion 80 which projects at a 90° angle from the side wall 40'' and away from the vent slot 26'' (shown in FIGS. 7 and 9). An upper cap-engaging portion 42'' extends from the lip portion 80 and projects in the other direction towards the vent slot 26''. The height of the side wall 40'' is preferably selected such that the ridge cap-engaging portion 42'' of the clip 30'' is flush with the top ends of the standing seams 70''.

The clip 30'' has a hook portion 46'' defined by a lower leg 48'' and an upper leg 50'' spaced by a curved portion 52'', which is slipped over the upper edge 34 of the metal panels 14. The clip 30'' is bent to define a channel 44'' by the upper leg 50'' of the hook portion 46'' and the cap engaging portion 42''. The hook portion 46'' slides onto the metal panels 14'' with the vertical standing seam 70'' being received by the slot 54''. Similar to the previous embodiment, the air-permeable venting material sections 32'' extend between adjacent clips 30''. A comer of a section of air-permeable venting material 32'' is then slightly compressed and inserted into the channel 44''. The clip is sized to the thickness of the venting material such that the venting material is at least flush with, and preferably slightly compressed by, the cap-engaging portion 42''.

Referring to FIG. 9, the operation of installing the clip 30'' and the ridge cap 28'' is slightly different than in the first two embodiments. Similar to the previous embodiments, the clip 30'' can arrive on the job site as a flat sheet and is bent to form the clip 30'' with the hook portion 46'' sized to the thickness of the metal panels, with the side wall 40'' of a proper size relative to the standing seem 70'' such that the upper cap-engaging portion 42'' is flush with the top of the standing seam 70'' when installed. The hook portion 46'' of the clip 30 is slipped over the upper edge 34'' of the metal panels 14 straddling the standing seam 70'', with the slot 54'' receiving the standing seam 70''. A corner of a section of the venting material 32'' is compressed slightly to slide into the channel 44''. The sections of venting material 32'' are placed in this manner such that the sections extend along the vent slot between adjacent clips 30'.

In contrast to the first two embodiments, the ridge cap 28'' is installed by pulling the lip portion 80 of the clip 30″ upward, therein raising the top cap-engaging portion 42″ above the level of the standing seam 70″. The curved lip edge 78 of the ridge cap 28″ is snapped over the lip portion 80. The lip portion 80 is released and the upper leg portion 50″ which had flexed upward to allow the movement of the lip portion 80 upward, urges the ridge cap 28″ and the lip portion 80 downward such that the curved lip portion 70 of the ridge cap 28″ is in engagement with the standing seam 70″. The venting material 32″ completely fills the space between the panels 14″ and the ridge cap 28″ to prevent water, dirt and insects from entering, but allows the passage of air.

It is evident from the foregoing that various modifications, which are apparent to those skilled in the art, can be made to the embodiments of this invention without departing from the spirit or scope thereof. For example, and not intending to list all of the possible modifications, it is apparent that different fasteners may be substituted where appropriate, such as screws or adhesive for nails, etc., and that different materials may be used to accomplish the same or equivalent effect as the structures described in the preferred embodiments. While the standing seams 16 are shown aligned across the opening in the embodiments shown, which is the most common arrangement for aesthetic appearance and is desired for ease in securing the ridge cap 28, the alignment of the standing seams across the opening 26 is not necessary for the installation of the clips 30 or the venting material 32. Consequently, one seeking to determine the scope of the invention should refer first to the claims located at the end of this specification.

That which is claimed is:

1. A roof ventilation system for ventilating a building having a sloped metal roof formed of a series of metal panels joined by standing seams, said system comprising a vent slot disposed along the roof ridge adapted to permit air from interior space under the roof to flow through the slot to the exterior, and a ridge cap supported and secured over said slot; CHARACTERIZED BY:

(a) a plurality of clips disposed at intervals on each side of the vent slot, each clip engaging with an upper edge of said metal panels and straddling a standing seam, said clips adapted to support and secure the ridge cap and to retain air-permeable venting material along the vent slot, wherein each clip includes:

(i) a cap-engaging portion for supporting and securing the ridge cap, (ii) a hook portion having a lower leg and an upper leg, said legs spaced from each other for receiving an upper edge of adjacent metal panels between said upper and lower leg to engage the clip to the metal panels, (iii) a wall portion extending between the upper leg of the hook portion and the cap-engaging portion, wherein the cap-engaging portion, the upper leg and the side wall portion define a channel for retaining air-permeable venting material, and (iv) wherein a slot extends through the wall portion and at least partially through the cap-engaging portion and upper leg, for receiving the standing seam; and (b) a plurality of sections of air-permeable venting material, each section extending between adjacent clips along a side of the vent slot, said material retained in the channels of the clips.

2. A roof ventilation system of claim 1, wherein the standing seams on opposite sides of the open slot are aligned across the opening.

3. A roof ventilation system of claim 1 wherein the wall portion extends to a height above the upper leg of the hook portion sufficient for spacing the cap-engaging portion essentially flush with the top ends of the standing seams.

4. A roof ventilation system as in claim 1 wherein the ridge cap is comprised of overlapping cap elements extending between the clips and secured to the clips, and which are in engagement with venting material between the clips.

5. A roof ventilation system as in claim 4, wherein each ridge cap element is secured to a clip by a screw extending between the cap element and the cap-engaging portion of the clip and into the air-permeable venting material.

6. A roof ventilation system as in claim 4, wherein the ridge cap has a curved lip edge and the clip having a lip portion extending between the cap-engaging portion and the wall portion for engaging and securing the curved lip edge of the ridge cap.

7. A clip member for use in a metal roof ridge ventilating system, said clip member adapted to engage with an upper edge of a metal roof panel and to straddle a standing seam between roof panels, said clip member adapted to support and secure a ridge cap above a vent slot along the ridge of the roof and to retain air-permeable venting material along the vent slot, the clip member comprising:

(i) a cap-engaging portion for supporting and securing the ridge cap, (ii) a hook portion having a lower leg and an upper leg, said legs spaced from each other for receiving an upper edge of adjacent metal panels between said upper and lower leg to engage the clip to the metal panels, (iii) a wall portion extending between the upper leg of the hook portion and the cap-engaging portion, wherein the cap-engaging portion, the upper leg and the side wall portion define a channel for retaining air-permeable venting material, and (iv) wherein a slot extends through the wall portion and at least partially through the cap-engaging portion and upper leg, for receiving the standing seam.

8. A clip member as in claim 7, wherein the clip further comprises a lip portion extending between the cap-engaging portion and the wall portion for securing the ridge cap.

9. A method of installing a ridge ventilation system on a sloped roof covered by a metal roof consisting of a series of adjoining metal panels joined by a standing seams, the method comprising the steps of:

(a) creating an open vent slot disposed along the roof ridge;

(b) providing a plurality of clips, each having:

(i) a ridge cap-engaging portion for supporting and securing a ridge cap, (ii) a hook portion having a lower leg and an upper leg, said legs spaced from each other by a curved portion, for receiving an edge of a metal panel between said upper and lower leg to engage the clip to the metal panel, (iii) a wall portion extending between the upper leg of the hook portion and the cap-engaging portion, wherein the cap-engaging portion, the upper leg and the side wall portion define a channel for retaining air-permeable venting material, and (iv) wherein a slot extends through the wall portion and at least partially through the cap-engaging portion and upper leg, for receiving a standing seam;

(c) spacing said clips at intervals along each side of the vent slot by sliding the hook portion of each clip onto an upper edge of adjoining metal panels with the clip's slot receiving the standing seam which joins the panels such that the clip straddles the seam;

(d) installing a plurality of air-permeable venting material sections between clips along each side of the vent slot by compressing a corner edge of the material section and placing said comer edge in the channel of a clip;

(e) installing a ridge cap by placing cap elements over the venting material sections and clips;

(f) securing each cap element to an underlying clip by a fastener extending through the ridge cap and cap-engaging portion of the clip and into the venting material.

10. A method of installing a ridge ventilation system of claim 9 further comprising the step of forming the clip comprising the sub-steps of:

(i) providing a flat, generally rectangular, metal sheet with a through slot along its longitudinal centerline;

(i) folding the flat metal sheet approximately 90° to form the upper cap-engaging portion and an interim long portion;

(ii) folding the long portion approximately 90° in the same direction as the cap engaging portion to form the wall portion and an interim hook portion, and (iii) folding the interim hook portion at approximately its mid-length to reflect back approximately 180°, thus forming the upper leg and lower leg wherein the bend defines the curved portion.

* * * * *